US005856838A

United States Patent [19]

Oda et al.

[11] Patent Number: 5,856,838

[45] **Date of Patent: *Jan. 5, 1999**

[54] INK SUPPLY DEVICE AND RECORDING APPARATUS

[75] Inventors: Kazuyuki Oda; Katsuyuki Fujii, both of Ebina, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 800,339

[22] Filed: Feb. 14, 1997

[30] Foreign Application Priority Data

Feb. 21, 1996 [JP] Japan ..... 8-033248

[51] Int. Cl.[6] ..... B41J 2/175

[52] U.S. Cl. ..... 347/85; 347/86

[58] Field of Search ..... 347/86, 87, 85

[56] References Cited

U.S. PATENT DOCUMENTS

| | | | |
|---|---|---|---|
| 4,422,084 | 12/1983 | Saito | 347/86 |
| 4,436,439 | 3/1984 | Koto | 347/87 |
| 5,119,115 | 6/1992 | Buat et al. | 347/86 |
| 5,158,377 | 10/1992 | Suzuki et al. | 400/124 |
| 5,552,816 | 9/1996 | Oda et al. | 347/86 |
| 5,555,238 | 9/1996 | Miyazawa | 347/86 |
| 5,623,291 | 4/1997 | Morandotti et al. | 347/87 |
| 5,631,683 | 5/1997 | Nishioka et al. | 347/87 |
| 5,633,666 | 5/1997 | Haigo | 347/86 |

FOREIGN PATENT DOCUMENTS

| | | | |
|---|---|---|---|
| 0 488 829 A2 | 6/1992 | European Pat. Off. . | |
| 488829 | 6/1992 | European Pat. Off. | 347/87 |
| 0 529 879 A1 | 3/1993 | European Pat. Off. . | |
| 529880 | 3/1993 | European Pat. Off. | 347/87 |
| 0 605 183 A2 | 7/1994 | European Pat. Off. . | |
| 0 727 314 A2 | 8/1996 | European Pat. Off. . | |
| 0 728 586 | 8/1996 | European Pat. Off. . | |
| 63-276554 | 11/1988 | Japan . | |
| A-3-87266 | 4/1991 | Japan . | |
| A-3-180357 | 8/1991 | Japan . | |
| 5-8405 | 1/1993 | Japan | 347/86 |
| 05096744 | 4/1993 | Japan . | |
| 6-238908 | 8/1994 | Japan . | |
| 7-052405 | 2/1995 | Japan . | |
| A-7-52405 | 2/1995 | Japan . | |
| 7-068783 | 3/1995 | Japan . | |
| A-7-81084 | 3/1995 | Japan . | |
| 7-089088 | 4/1995 | Japan . | |
| A-8-207298 | 8/1996 | Japan . | |
| 8-224884 | 9/1996 | Japan . | |

OTHER PUBLICATIONS

Anonymous, "Replaceable Ink Cartridge for Ink Jet Print Head", IBM Technical Disclosure Bulletin, vol. 34, No. 1, Jun. 1991, pp. 459–462.

*Primary Examiner*—Edgar Burr
*Assistant Examiner*—Daniel J. Colilla
*Attorney, Agent, or Firm*—Oliff & Berridge, PLC

[57] ABSTRACT

An ink supply device for supplying ink to a print head, the device containing a main ink chamber, an intermediate ink chamber, a first meniscus forming member with pores between the main and intermediate ink chambers and a joint portion between the first meniscus forming member and the print head. The ink supply device holds ink by negative pressure maintained therein and extends the efficiency of the ink supply device. Preferably, the intermediate ink chamber is hermetically sealed.

7 Claims, 13 Drawing Sheets

INK SUPPLY DEVICE AND RECORDING APPARATUS

BACKGROUND OF THE INVENTION

The present invention relates to an ink supply device for use in a recording apparatus utilizing liquid ink such as an ink-jet recording apparatus, for example, and more particularly to a recording apparatus using such an ink supply device.

A known ink supply device of the sort described in U.S. Pat. No. 5,158,377 for a recording apparatus using liquid ink, for example, is adapted so that ink is supplied to a print head by directly pressing a porous member for holding ink against a capillary member which is provided for the print head.

In the recording apparatus like this, it has been so arranged that a suitable negative pressure is maintained in a print head. In the case of an ink-jet pen as described in the Unexamined Japanese Patent Application Publication No. Hei 3-180357, bubbles corresponding the volume of ink to be consumed is introduced from a bubble generator in a hermetically-sealed housing so as to store the ink with the negative pressure maintained therein. Notwithstanding, no consideration has been given to the problem of an outflow of ink, depending on the position of the housing.

Each of the ink supply devices of FIGS. 7 to 11 has, as described in the Unexamined Japanese Patent Application Publications No. Hei 7-52405 and No. Hei 7-81084, a main ink chamber communicating with a print head, a sub ink chamber with a capillary member disposed therein, a meniscus forming member having a number of pores provided in part of the wall of the main ink chamber, and an ink supply member for supplying a liquid to the meniscus forming member, wherein the bubble point differential pressure formed in the pores of the meniscus forming member by the ink supplied via the ink supply member keeps the pressure inside the ink chamber negative.

In such an ink supply device as mentioned above, the bubble point pressure in the meniscus forming member causes air to be introduced into the intermediate ink chamber as ink is consumed when the printing operation is performed by the print head. When the position of the print head varies in the state above due to the variation of the installation position of an printer body, the replacement of the print head or the ink supply device left alone after being separated from the recording apparatus, the ink in the main ink chamber is moved while being attracted by the capillary member in the sub ink chamber and the atmospheric air kept in contact with the meniscus forming member of the sub ink chamber is allowed to penetrate into the main ink chamber in the form of bubbles instead; the problem is that because the ink is replaced with the air, the residual ink may become unusable at the time the remaining printing condition is restored.

Even in the ink supply device of FIGS. 4 to 6 with the ink chamber and the ink chamber equipped with the capillary member being vertically arranged according to the Unexamined Japanese Patent Application Publication No. 7-81084, there is raised the same problem, depending on the position of the ink supply device.

Particularly when the position of the ink supply device varies often, it also poses a serious problem that ink is replaced with the air in the ink chamber.

SUMMARY OF THE INVENTION

An object of the present invention made in view of the foregoing problems is to provide a highly reliable ink supply device capably of holding ink with the negative pressure maintained therein and free from incurring a reduction in the efficiency of use even when the ink supply device is left alone in various positions, and a recording apparatus using the ink supply device.

According to the invention of aspect 1, an ink supply device for supplying ink to a print head comprises: a communicating hole for use in supplying ink, a first meniscus forming member with pores formed in the communicating hole, a first ink chamber capable of containing ink under a negative pressure, a joint portion communicating with the communicating hole and simultaneously with the print head, and a hermetically sealed second ink chamber, wherein the following relation is satisfied:

$$|PB| \geqq |PR| + |PH|$$

where PR=negative pressure generated in the first ink chamber; PB=bubble point pressure of the first meniscus forming member; and PH=hydraulic head pressure of ink acting on the face on the first ink chamber side of the first meniscus forming member.

According to the invention of aspect 2, the ink supply device according to aspect 1 is characterized in that the following relation is satisfied by setting the bubble point pressure of the first meniscus forming member:

$$|PB| \geqq |PR| + |PH|$$

According to the invention of aspect 3, the ink supply device according to either aspect 1 or aspect 2, the first ink chamber includes a communicating-with-air hole communicating with the external atmospheric air and a porous member communicating with the communicating-with-air hole, wherein the negative pressure is generated by the capillary force of the porous member.

According to the invention of aspect 4, the ink supply device according to either aspect 1 or aspect 2, the first ink chamber has a bubble generator on a part of the wall surface in the proximity of a base thereof so that the negative pressure is generated by the bubble point pressure of the bubble generator.

According to the invention of aspect 5, the ink supply device according to either aspect 1 or aspect 2, the first ink chamber has a movable member for containing ink, so that the negative pressure is maintained by the movable member.

According to the invention of aspect 6, the ink supply device according to aspect 3, the porous member is formed of polyester felt whose density ranges from 0.04 g/cm$^3$ to 0.2 g/cm$^3$.

According to the invention of aspect 7, the ink supply device according to one of aspects 1 to 6, the first meniscus forming member is a twill fabric filter of SUS whose filtering particle size ranges from about 5 $\mu$m to about 80 $\mu$m.

According to the invention of aspect 8, the ink supply device according to one of aspects 1 to 7, the joint portion of the second ink chamber includes a second meniscus forming member and the following relation is satisfied:

$$|PB2| \geqq |PR| + |PH|$$

where PB2=bubble point pressure of the second meniscus forming member; PR=negative pressure generated in the first ink chamber; and PH=hydraulic head pressure of ink acting on the face on the first ink chamber side of the first meniscus forming member.

According to the invention of aspect 9, the ink supply device according to one of aspects 1 to 8, the hydraulic head pressure PH is hydraulic head pressure acting on the first meniscus forming member when the ink supply device is placed in a position different from the normal position in which the ink supply device is placed.

According to the invention of aspect 10, the ink supply device according to one of aspects 1 to 9, wherein the hydraulic head pressure PH is the largest hydraulic head pressure obtainable when the first ink chamber is filled with ink.

According to the invention of aspect 11, a recording apparatus having an ink supply device according to one of aspects 1 to 10.

DETAILED DESCRIPTION OF THE PREFERRED EMBODIMENTS

Figure 1A:
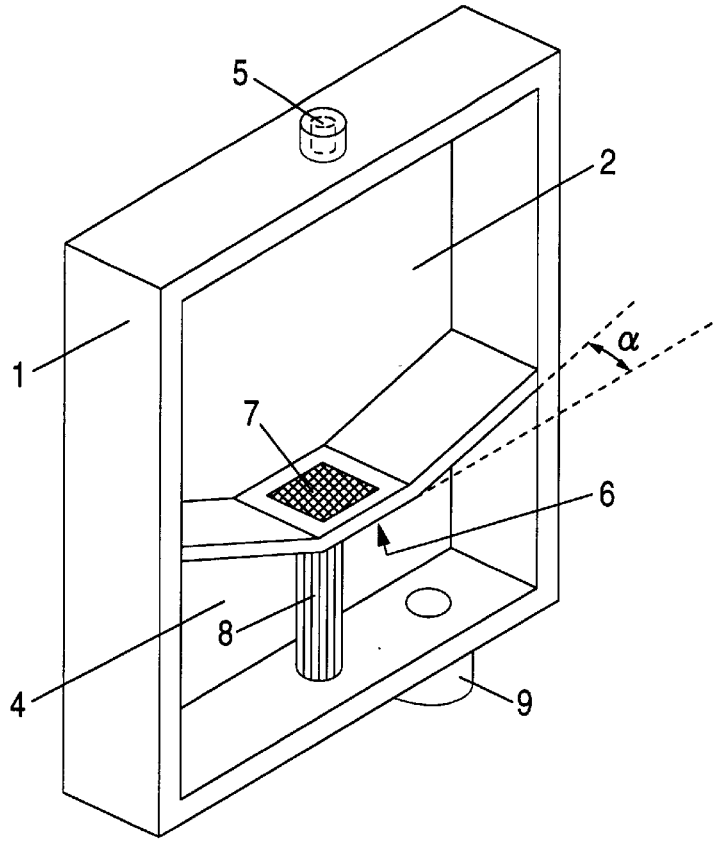
FIG. 1A is a perspective view of an ink supply device according to a first embodiment of the invention.
Figure 1B:
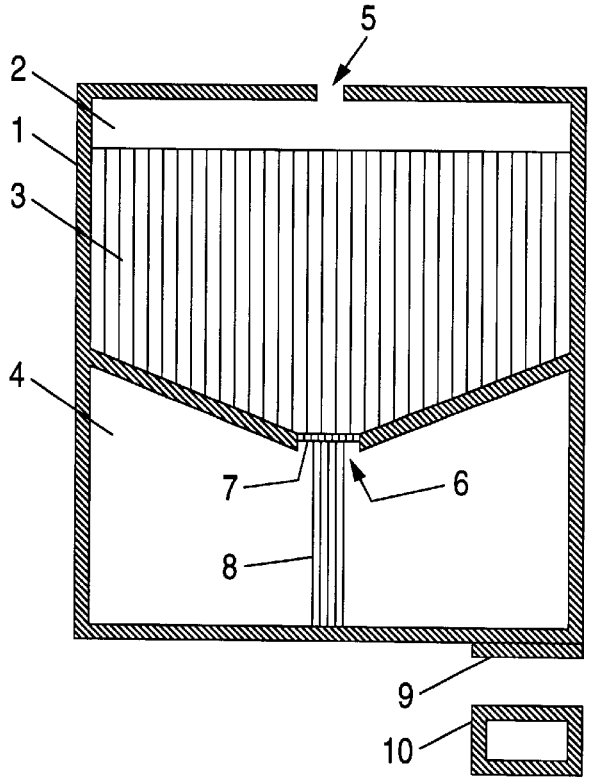
FIG. 1B is a sectional view thereof.

FIG. 1A schematically illustrates an ink supply device as a first embodiment of the invention: FIG. 1A is a perspective view of the ink supply device; and FIG. 1B a sectional view thereof. In FIG. 1A, reference numeral 1 denotes a housing 1; 2, a main ink chamber; 3, a capillary member; 4, an intermediate ink chamber; 5, a communicating-with-air hole; 6, a communicating hole; 7, a first meniscus forming member; 8, an ink supply member; 9, a joint portion; and 10, a print head. According to this embodiment of the invention, there is shown a recording apparatus of such a type as is separated from a print head. In the perspective view of FIG. 1A; the illustration of the side wall on this side and the capillary member 3 is omitted.

The ink supply device is provided with the main ink chamber 2 and the intermediate ink chamber 4 situated below the main ink chamber 2 therein. Hereinafter, "main ink chamber" is used interchangeably with "first ink chamber" and "intermediate ink chamber" is used interchangeably with "second ink chamber." The housing 1 is rigid and selectively made of material resistant to ink in order to hold ink for a long period of time. The joint portion 9 of the ink supply device is coupled to the print head 10. The ink in the intermediate ink chamber 4 is passed through the joint portion 9 before being supplied to the print head 10.

The communicating hole 6 is provided in the lower portion of the main ink chamber 2, which hole is kept communicating with the intermediate ink chamber 4 and the joint portion 9. The sectional shape of the communicating hole 6 may be varied; for example, it may be circular, elliptic, polygonal, star-, cross-, slit-shaped or the like. Further, the base of the main ink chamber 2 is tilted so as to make the communicating hole 6 the lowest portion. Each tilted face forms an angle of $\alpha°$ with a horizontal plane in which the first meniscus forming member 7 is installed as shown in FIG. 2.

In the main ink chamber 2 lies the capillary member 3. This capillary member 3 is used to hold ink by means of the capillary force so as to maintain negative pressure in a recording head. With respect to the material of which the capillary member 3 is made, use can be made of a fibrous material of two-dimensional structure, a porous material of three-dimensional structure, felt prepared by spinning a fibrous material into three-dimensional structure, a felted fabric and the like. More specifically, middle drafts obtainable by unidirectionally bundling polyester fibers, for example.

Figure 2:
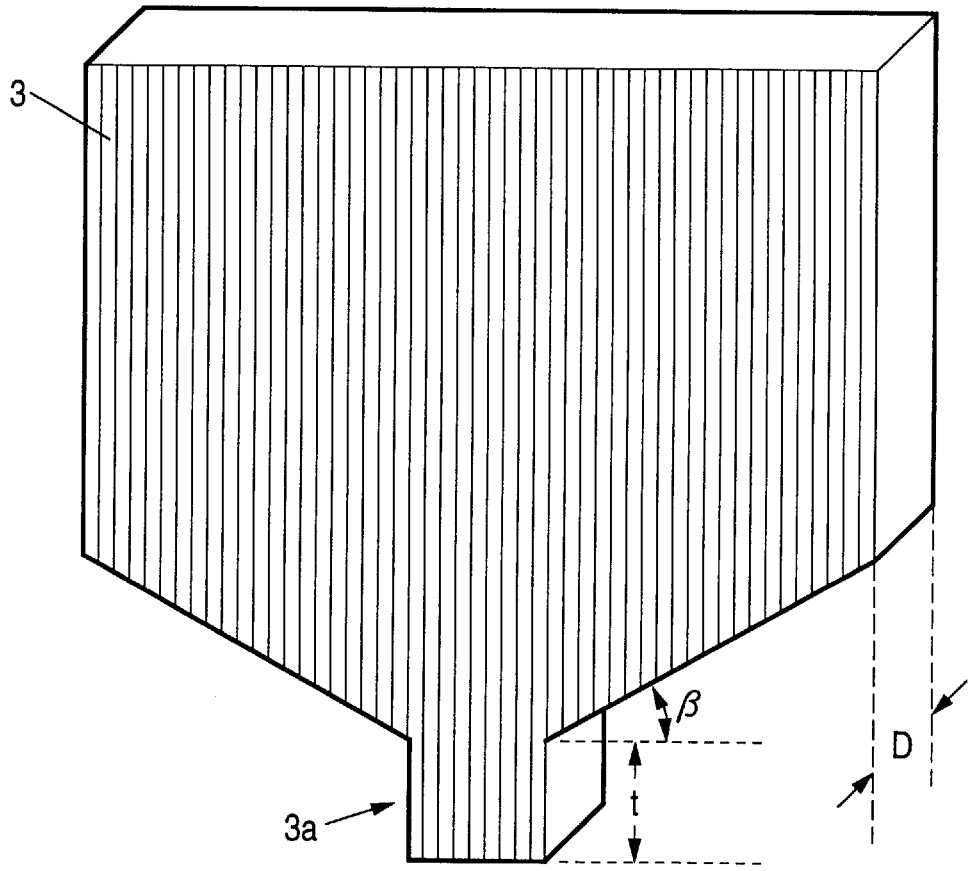
FIG. 2 is a diagram illustrating the shape of a capillary member.

FIG. 2 shows the shape of the capillary member 3, wherein 3*a* represents a projected portion. The capillary member 3 is similar in configuration to the main ink chamber 2, which is slightly larger in size than the former, and the thickness thereof is substantially the same as or slightly larger than the depth D of an ink tank. The capillary member 3 is inserted into the main ink chamber 2 during the operation.

The base of the capillary member 3 has tilted faces each of which forms an angle of $\beta°$ with the plane in parallel to the surface of the capillary member 3. Further, the projected portion 3*a* in contact with the first meniscus forming member 7 provided in the communicating hole 6 illustrated in FIG. 1 is formed so that it has a height of $\underline{t}$ mm.

The angle $\alpha$ of FIG. 1 is related to the angle $\beta$ of FIG. 2 by $\beta>\alpha$ and preferably $\beta-\alpha=15°$. Further, the height $\underline{t}$ of the projected portion 3*a* is given by t=4 mm as a preferred example. When the capillary member thus formed is loaded in the main ink chamber 2 of FIG. 1 so that the capillary member is brought into contact with the whole base of the main ink chamber, the projected portion 3*a* is compressed in the surface of the first meniscus forming member 7, whereby there is formed a portion having a specifically high density. The high density is also attained on the periphery of the communicating hole 6, especially in the proximity of the communicating hole 6 because of a difference in the inclination of the titled face; a density gradient is thus generated. Therefore, ink is caused to move from the end of the capillary member where not only the ink density but also ink holding force is low when the ink is consumed by the recording head and the quantity of ultimate residual ink becomes smaller, so that ink can be supplied with great efficiency.

The ink supply member 8 is made of material different from what is used for forming the first meniscus forming member 7 and has a sectional diameter smaller than that of the communicating hole 6 and besides is brought into contact with the first meniscus forming member 7. The ink supply member 8 may be fitted to the first meniscus forming member 7 directly or otherwise secured thereto with support members such as ribs extended from the side wall of the intermediate ink chamber 4. The ink supply member 8 may be made of material which is not necessarily the same as what is used for forming the first meniscus forming member 7 but may be made of any material as long as this material is fit for sucking up ink into the first meniscus forming member by means of the capillary force. For example, use can be made of middle drafts obtainable by unidirectionally bundling polyester fibers, porous members of polyurethane or melamine foam, a fibrous material of two-dimensional structure, a porous material of three-dimensional structure or the like.

Part of the first meniscus forming member 7 may be extended up to the base of the intermediate ink chamber 4, so that the part may be used as the ink supply member 8. When bubbles collect together on the underside of the first meniscus forming member 7, thus causing an air layer to build up or when the ink in the main ink chamber 2 is used up, which results in making the liquid level of the ink lower than the height of the intermediate ink chamber 4, the ink supply member 8 operates to suck up ink from the base of the intermediate ink chamber 4 and supplies the ink to the first meniscus forming member 7. In other words, the first meniscus forming member 7 is always kept in a wet condition with the negative pressure maintained therein. Thus the best operating condition is maintained until the ink is completely used up. The ink supply member 8 may have any sectional shape, for example, may be in the form of a slit, a rectangular prism, a prism such as a triangle, a cylinder or an elliptic cylinder.

Figure 3:
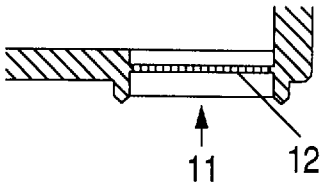
FIG. 3 is a sectional view of a joint portion according to an embodiment of the invention.

FIG. 3 is a sectional view of the joint portion according to this embodiment of the invention. In FIG. 3, reference numeral 11 denotes a joint port; and 12, a second meniscus forming member. The second meniscus forming member 12 is provided in the joint port 11. The second meniscus forming member 12 has a bubble point pressure because of pores as in the first meniscus forming member. While the ink supply device is removed and left alone, the surface tension of ink formed in the pores of the second meniscus forming member 12 prevents air from penetrating into the ink tank and also the ink from leaking out because the negative pressure in the ink tank draws in the external air (atmospheric pressure). Moreover, the air allowed to remain in the joint port 11 due to the pressure built up when the ink supply device is installed in the recording apparatus is passed through the ink film of the second meniscus forming member 12 before being moved into the intermediate ink chamber. Consequently, bubbles are restrained from creeping into the print head. Further, the second meniscus forming member 12 functions as a filter having a minute filtering diameter so as to remove alien substances existing in the ink in such a state that the ink supply device has been installed. Simultaneously, the following is prevented; namely, the vibration and the impact applied to the ink supply device, pressure fluctuation because of acceleration, and the creeping of bubbles from the nozzle side of the print head.

Although a description has been given of a case where the print head is to be connected to the joint port of the joint portion as a premise, the present invention is not limited to the above case. The joint port of an ink supply device may be connected to a connecting port communicating with the print head installed in a recording apparatus or otherwise an ink supply device may be combined integrally with a-print head.

Like the first meniscus forming member, the second meniscus forming member 12 may be formed of a metal or resin mesh, or a porous material. More specifically, use can be made of a metal filter mesh, a filter formed of a compressed sintered metal fibrous material or an electroforming metal filter; for example, use can be made of a filter as knitted goods of resinous fibers or metal such as twill fabrics or a filter having a highly-precise pore diameter as a result of laser- or electronic-beam processing.

An absorbent material may be provided so that ink sticking to the joint port 11 is prevented from dropping when the ink supply device is detached from the recording apparatus. Such an absorbent material for use has an excellent absorbent capacity and may be formed with a sponge or middle drafts obtainable by unidirectionally bundling polyester fibers. The absorbent material is desired to have low channel resistance. Moreover, the absorbent material may be provided on the recording apparatus side to which the ink supply device is fitted.

Figure 4:
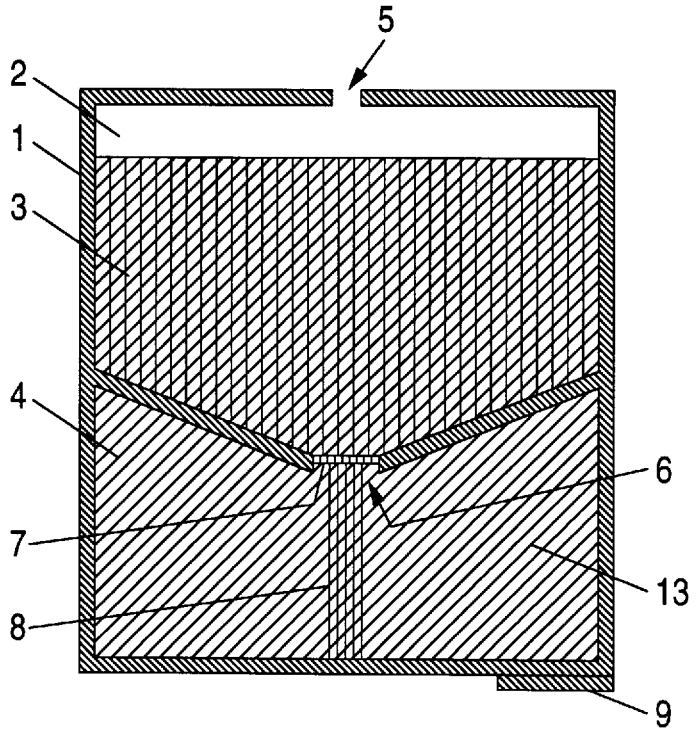
FIG. 4 is a diagram illustrating the operation of the ink supply device in the first embodiment of the invention.

FIGS. 4 to 10 are diagrams illustrating the operation of the ink supply device as the first embodiment of the invention by way of example. In FIGS. 4 to 10, like reference characters designate like or corresponding parts throughout and the description thereof will be omitted; incidentally, reference numeral 13 with tilted hatching denotes ink. FIG. 4 shows the ink supply device in a before-use state. Since the ink supply device according to the present invention is of a separate type, the print head has not been attached to the main ink chamber 2 and the intermediate ink chamber 4 of the ink supply device in the above state.

FIG. 4 shows the ink supply device of FIG. 1 in the before-use state, which ink supply device has been filled with ink. In this state, the main ink chamber 2 has been filled with ink to the extent that the ink is held by the capillary force of the capillary member 3. In view of efficiency of use of ink in that before-use state, it is desired that the main ink chamber 2 is filled with ink as much as possible. However, the capillary member 3 needs a certain portion free from being filled with ink in order to cause negative pressure to be generated by the capillary force of the capillary member 3. The intermediate ink chamber 4 has been filled with the ink 13. Before use, the opening of the joint portion 9 and the communicating-with-air hole 5 may be pasted up with respective hermetic seals. The ink supply device is packaged in this state. When the ink supply device is used, it is installed in the recording apparatus after the hermetic seals are removed.

When the ink supply device is installed in the recording apparatus, a small quantity of air may be left in the joint portion 9. The residual air in the form of bubbles is allowed to penetrate into the intermediate ink chamber 4 because of the pressure applied at the time the ink supply device is installed. The bubbles thus caused to penetrate into the intermediate ink chamber 4 are moved along the tilted surfaces of the intermediate ink chamber 4 by the buoyancy of the bubbles themselves and gathered in the upper portion.

When the printing operation is started after the ink supply device is installed, ink is consumed in the print head 10.

Figure 5:
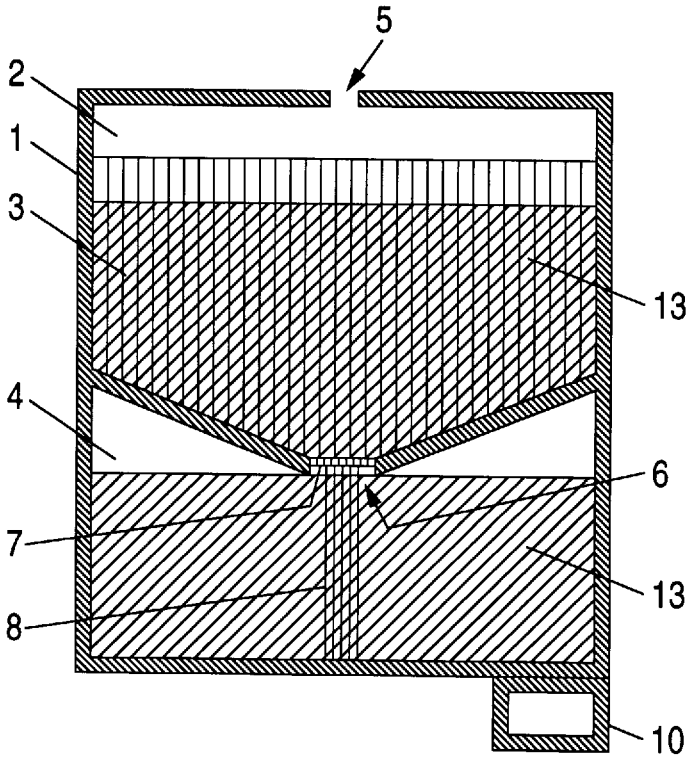
FIG. 5 is a diagram illustrating the operation of the ink supply device in the first embodiment of the invention.

Then air gradually spreads out from the communicating-with-air hole 5 into the capillary member 3 by the consumed amount of ink as shown in FIG. 5. As the ink held in the capillary member 3 decreases, the hydraulic head pressure of ink also lowers. Although the negative pressure gradually increases, it remains within an allowable range and even when the ink is reduced in quantity, the capillary force of the capillary member 3 allows the ink to be supplied to the print head 10 stably with the negative pressure. The ink held in the capillary member 3 is passed through the first meniscus forming member 7 before being smoothly moved into the intermediate ink chamber 4.

While ink is supplied during the normal printing operation, moreover, air penetrating through the communicating-with-air hole 5 tries to penetrate into the first meniscus forming member 7 along the wall surface of the main ink chamber 2. However, only a very small amount of air is able to reach the surface of the first meniscus forming member 7 because the base of the main ink chamber 2 and the capillary member 3 are kept in intimate contact with each other. Even if a certain amount of air reaches the surface of the first meniscus forming member 7, the air will be trapped on the first meniscus forming member 7, whereas the ink will be kept moving. In a case where the bubbles mixed with the ink are passed through the capillary member 3 and brought into contact with the surface of the first meniscus forming member 7, the air will also be trapped on the first meniscus forming member 7, whereas the ink is kept moving if the filtering particle size of the first meniscus forming member 7 is set smaller than that of the capillary member 3. The movement of the ink from the main ink chamber 2 to the intermediate ink chamber 4 continues until the ink held in the capillary member 3 is used up.

While the bubbles are trapped on the surface of the first meniscus forming member 7, ink may be sucked from the tips of nozzles as part of the maintenance operation in order to prevent the nozzles from being clogged. In this case, negative pressure larger than the normal negative pressure is generated because the ink is forced to be sucked from the tips of the nozzles. Moreover, negative pressure may become larger than the normal negative pressure when a large amount of ink is consumed because of a solid printing operation to be performed. Then the bubbles trapped on the surface of the first meniscus forming member 7 together with the ink may unusually be drawn into the intermediate ink chamber 4 through the pores. The bubbles drawn from the first meniscus forming member 7 into the intermediate ink chamber 4 are moved along the tilted surfaces of the intermediate ink chamber 4 before being gathered in the upper portion thereof. Even when the underside of the first meniscus forming member 7 is covered with the bubbles, the negative pressure is maintained because of the surface tension that the interface of the ink has, which interface is formed with the pores of the first meniscus forming member 7.

Figure 6:
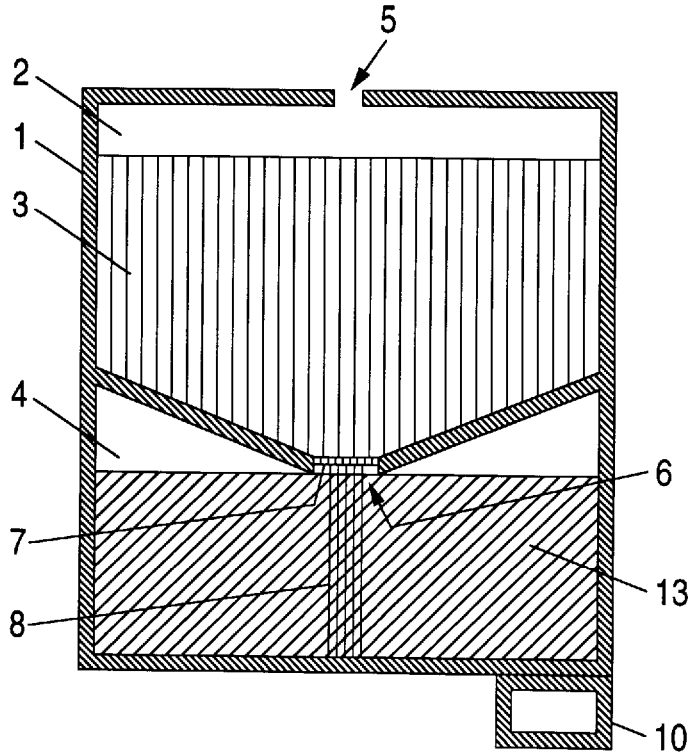
FIG. 6 is a diagram illustrating the operation of the ink supply device in the first embodiment of the invention.

When the ink held in the capillary member 3 substantially runs short, the first meniscus forming member 7 is brought into contact with air and FIG. 6 shows this state. In this state, the interface of the ink or the meniscus thereof is formed in the pores of the first meniscus forming member 7. When the printing operation is performed further, the ink 13 in the intermediate ink chamber 4 is consumed. As the ink 13 in the intermediate ink chamber 4 is consumed, the negative pressure in the intermediate ink chamber 4 is gradually increased. When a predetermined negative pressure value (the bubble point pressure of the ink determined by the filtering particle size of the first meniscus forming member 7) is added to the first meniscus forming member 7, however, fine air bubbles are produced on the underside of the first meniscus forming member 7 through the interface or meniscus of the ink formed on the first meniscus forming member 7. The fine bubbles thus produced are combined with fine bubbles produced in the proximity of the former bubbles and those following the former, and the combination of the bubbles grows into larger ones like the bubbles blown by a crab. Then the bubbles burst and air is introduced into the intermediate ink chamber 4, whereby an increase in the negative pressure is stopped, though the air thus introduced slightly raises the negative pressure. Therefore, the back pressure on the print head is maintained by the capillary force of the first meniscus forming member 7. For this reason, the presence of ink in the capillary tubes of the first meniscus forming member 7 is important. Even though the surface and undersurface of the first meniscus forming member 7 are brought into contact with air, the first meniscus forming member 7 is always kept wet because ink is sucked up from the intermediate ink chamber 4 into the first meniscus forming member 7. Consequently, an ink film is continuously formed in the first meniscus forming member 7 and the operation of controlling the negative pressure is effectively performed even after the bubbles are produced.

Figure 7:
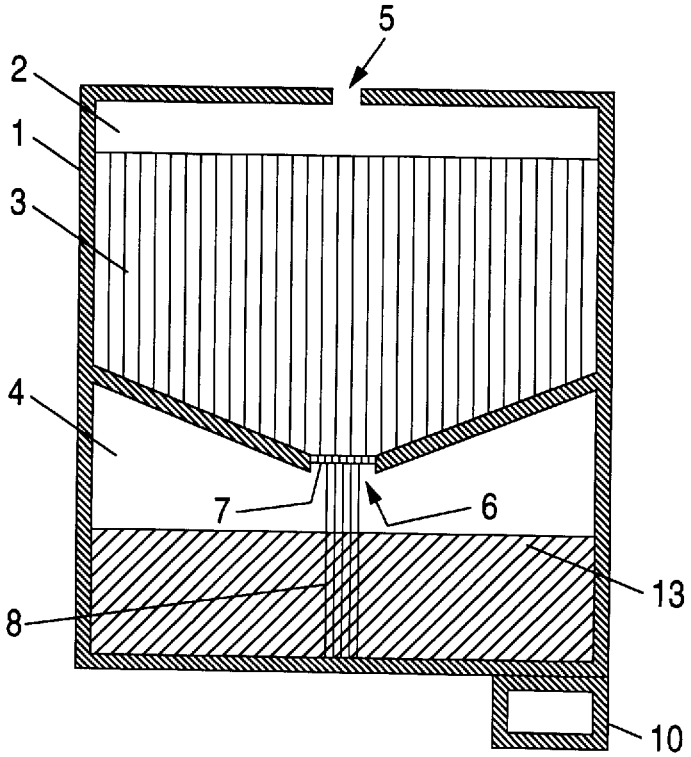
FIG. 7 is a diagram illustrating the operation of the ink supply device in the first embodiment of the invention.
Figure 8:
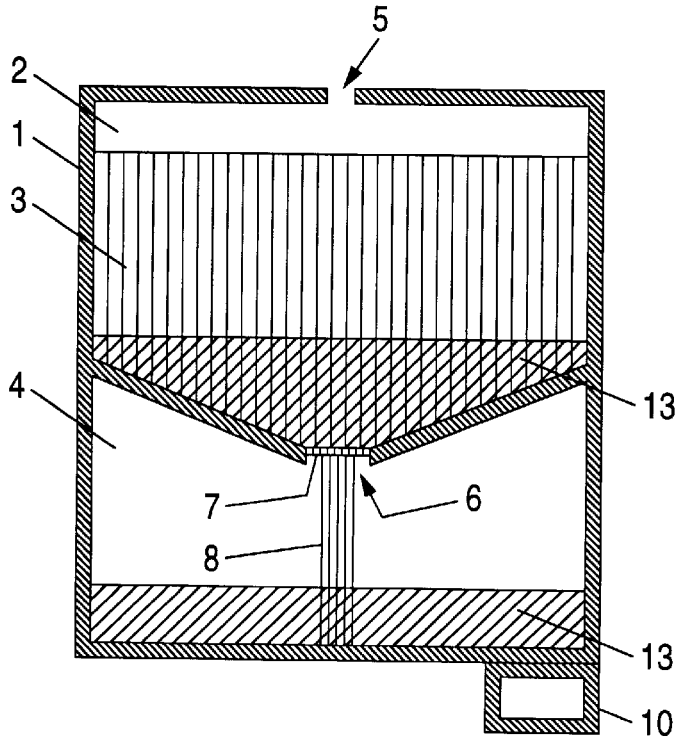
FIG. 8 is a diagram illustrating the operation of the ink supply device in the first embodiment of the invention.

When the environmental temperature rises or when the ambient pressure lowers in the state shown in FIG. 7, the air inside the intermediate ink chamber 4 expands as shown in FIG. 8 and the negative pressure is excessively reduced. However, part of the ink 13 in the intermediate ink chamber 4 is caused to flow reversely via the ink supply member 8 and the first meniscus forming member 7, so that the negative pressure in the intermediate ink chamber 4 is maintained. The back pressure on the print head 10 in this state is maintained by the capillary force of the capillary member 3.

Figure 9:
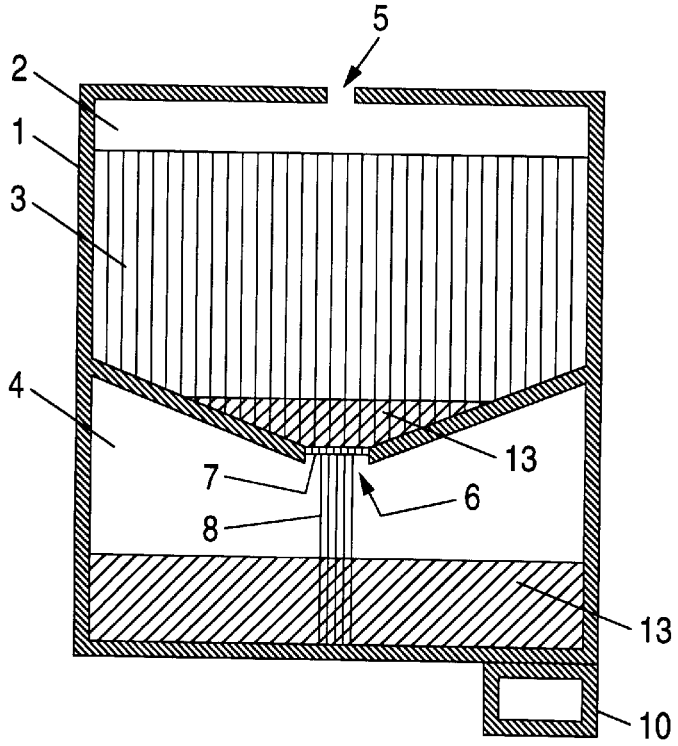
FIG. 9 is a diagram illustrating the operation of the ink supply device in the first embodiment of the invention.

When the environmental temperature lowers or when the ambient pressure rises again, the ink in the main ink chamber 2 is caused to flow into the intermediate ink chamber 4 via the first meniscus forming member 7 and the ink supply member 8, and the state shown in FIG. 9 is established. With the printing operation performed in the state shown in FIGS. 8 and 9, the ink in the main ink chamber 2 is consumed and the back pressure on the print head 10 is maintained by the capillary force of the capillary member 3.

When the environmental temperature lowers or when the ambient pressure rises further in the state shown in FIG. 8, the state shown in FIG. 7 is restored. Thus the movement of ink between the main ink chamber 2 and the intermediate ink chamber 4 because of environmental variations occurs in not only the state shown in FIG. 7 but also those shown in FIGS. 5 and 6.

Figure 10:
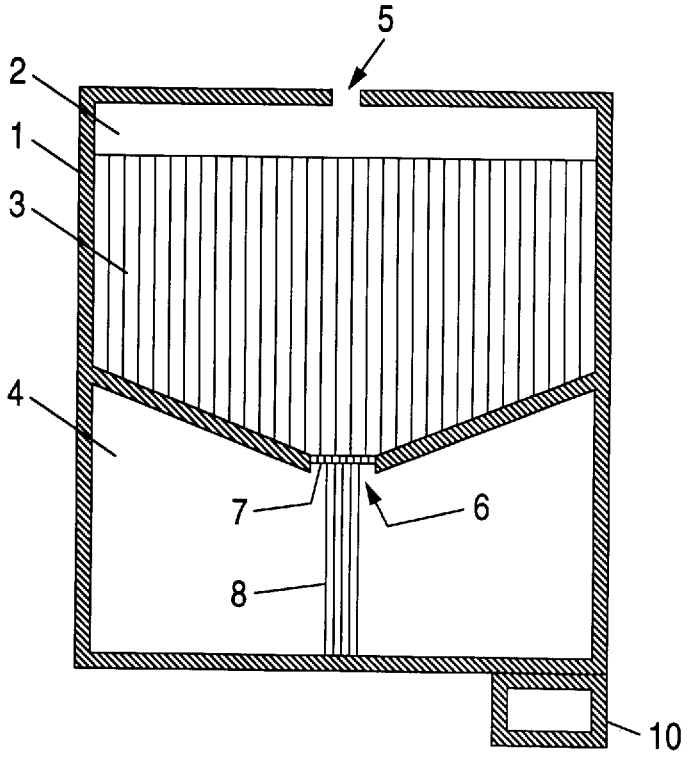
FIG. 10 is a diagram illustrating the operation of the ink supply device in the first embodiment of the invention.

The ink in the main ink chamber 2 is consumed in the way stated above and the ink in the intermediate ink chamber 4 is also consumed and when the ink in the intermediate ink chamber 4 is used up as shown in FIG. 10, the printing operation is terminated. Even at the time of such termination, the first meniscus forming member 7 remains wet with ink and the meniscus is formed simultaneously with the back pressure maintained on the print head.

Although a description has been given of a case where the ink held in the capillary member 3 of the main ink chamber is uniformly consumed, ink is actually left in a solid state in a portion where the density of the capillary member 3 is high.

Figure 11:
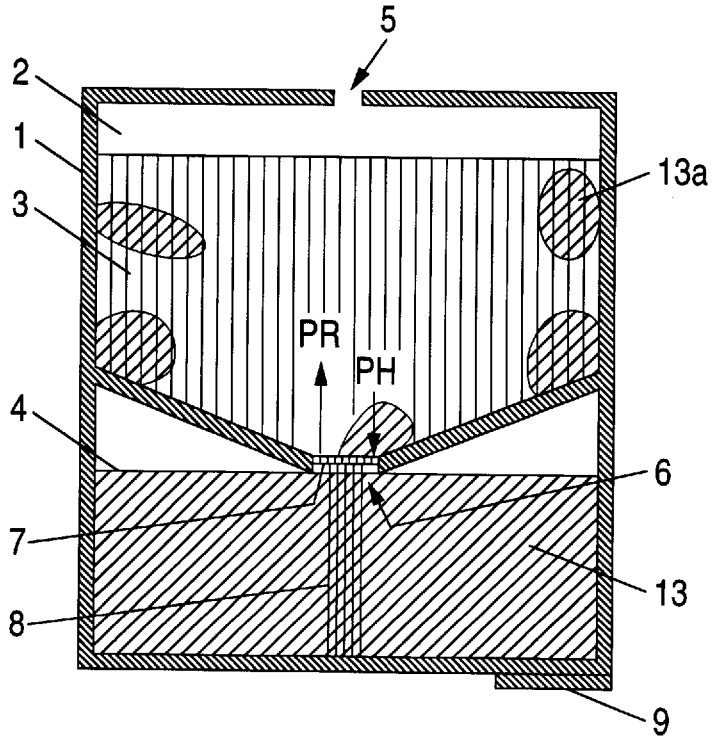
FIG. 11 is a diagram illustrating the condition of residual solid ink in the ink supply device.
Figure 12:
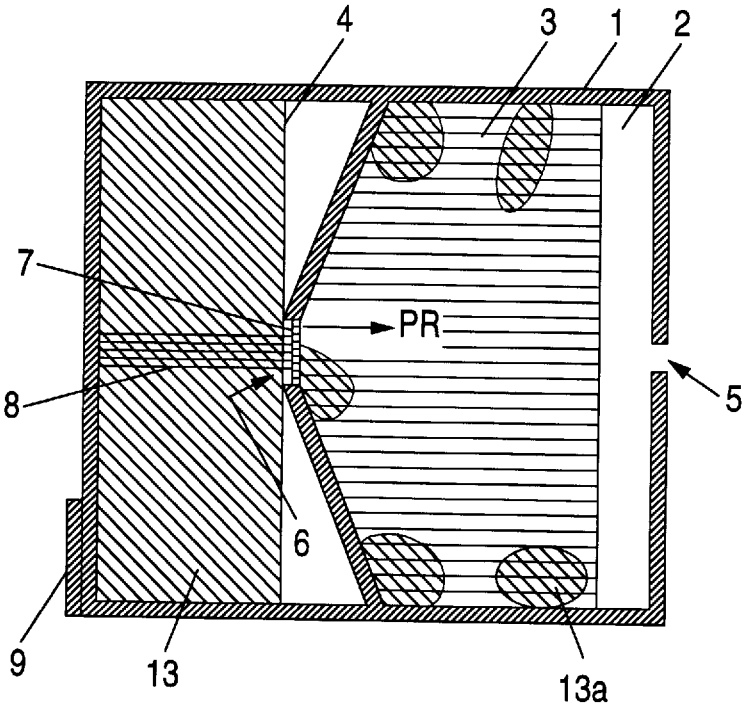
FIG. 12 is a diagram illustrating the ink supply device detached from a recording apparatus and fallen sideways.

FIG. 11 shows an exemplary state in which solid ink 13*a* remains in the state of FIG. 6. In this state, part of the surface of the first meniscus forming member 7 on the side of the main ink chamber 2 is kept in contact with a path of air flowing through the communicating-with-air hole and another part thereof is liquidly communicating with the residual solid ink. FIG. 11 also indicate the pressure PR generated by the capillary force and the hydraulic head pressure PH generated by the residual solid ink. The combined force generated by the solid ink becomes PZ=PR−PH. This combined pressure PZ is equal to the bubble point pressure of the first meniscus forming member 7 and the equilibrium condition is maintained.

When the ink supply device in the aforementioned state is removed from the recording apparatus temporarily at the time the whole recording apparatus is moved, its position may be changed from the normal position in which it is loaded on the printer, for example, the ink supply device may be fallen sideways. In this state, the hydraulic head pressure PH generated by the residual solid ink decreases and the combined pressure PZ resulting from the pressure generated by the residual solid ink increases, whereby the ink in the intermediate ink chamber 4 is drawn toward the main ink chamber side. Then the negative pressure in the intermediate ink chamber 4 rises and when the negative pressure exceeds the bubble point pressure of the first meniscus forming member 7, bubbles are caused to penetrate into the intermediate ink chamber 4. A series of these operations is repeated until the combined pressure PZ becomes equal to the bubble point pressure of the meniscus forming member and there occurs a substituting phenomenon in that the ink in the intermediate ink chamber is replaced with the air on the main ink chamber side. With the ink-to-air substituting phenomenon in the intermediate ink chamber, the communication between the print head and the ink will be cut if the whole ink in the intermediate ink chamber is made to move into the main ink chamber. Then the print head is unable to perform the printing operation, so that replacement of the ink supply device becomes necessary. The ink moved into and left in the main ink chamber is to be wasted without being used; therefore, the problem is that efficiency of use of ink on the part of such an ink supply device is lowered.

As a result of studies made to solve the above problem, the phenomenon associated with the substitution of the ink in the intermediate ink chamber for the air on the main ink chamber side was found uninducible without causing the meniscus of the first meniscus forming member to be damaged by satisfying the following relation no matter how much the position of the ink supply device is changed:

$$|PB| \geqq |PR| + |PH|$$

where PR=negative pressure generated in the main ink chamber; PH=hydraulic head pressure of ink acting on the face on the main ink chamber side of the first meniscus forming member; and PB=bubble point pressure of the first meniscus forming member.

In order to satisfy the relation, the wetting properties of the first meniscus forming member with respect to ink and the size of pores thereof are selected so as to increase the bubble point pressure PB. Further, the negative pressure PR may be reduced by decreasing the capillary force of the capillary member or the compressive force of the capillary member in the proximity of the first meniscus forming member may be lowered to make the residual solid ink nonexistent therein or otherwise the combination of the two methods above may be used to satisfy the relation above.

For the capillary member used to generate the pressure PR by means of the capillary force as a preferred embodiment of the present invention, use can be made of a fibrous material of two-dimensional structure, a porous material of three-dimensional structure such as urethane foam and melamine foam, felt prepared by spinning a fibrous material into three-dimensional structure, a felted fabric and the like. More specifically, for example, middle drafts obtainable by unidirectionally bundling polyester fibers are usable. The middle drafts having, for example, a density (=weight/volume) of 5% to 15% are usable. Polyester felt prepared by spinning a fibrous material into three-dimensional structure is also usable. The suitable density of this polyester felt ranges from 0.05 g/cm$^3$ to 0.2 g/cm$^3$. Notwithstanding, the material for use is not limited to polyester fiber and any other material may be used as long as it provides proper capillary force and ink resistance.

For the first meniscus forming member, netting such as wire netting and plastic netting, and any porous material can be used. As specific examples of netting, those usable include a metal mesh filter, metal fiber, for example, fine wires of SUS formed into felt or compression-sintered into a sintered metal filter, an electroforming metal filter, an electron-beam processed metal filter and a laser-beam processed metal filter. Particularly, the bubble point pressure free from variation is preferred and any filter having a highly precise pore diameter is suitable. According to this embodiment of the invention, a filter of twill fabrics of SUS is employed, which filter preferably has a filtering particle size of 5 $\mu$m to 80 $\mu$m.

Figure 13:
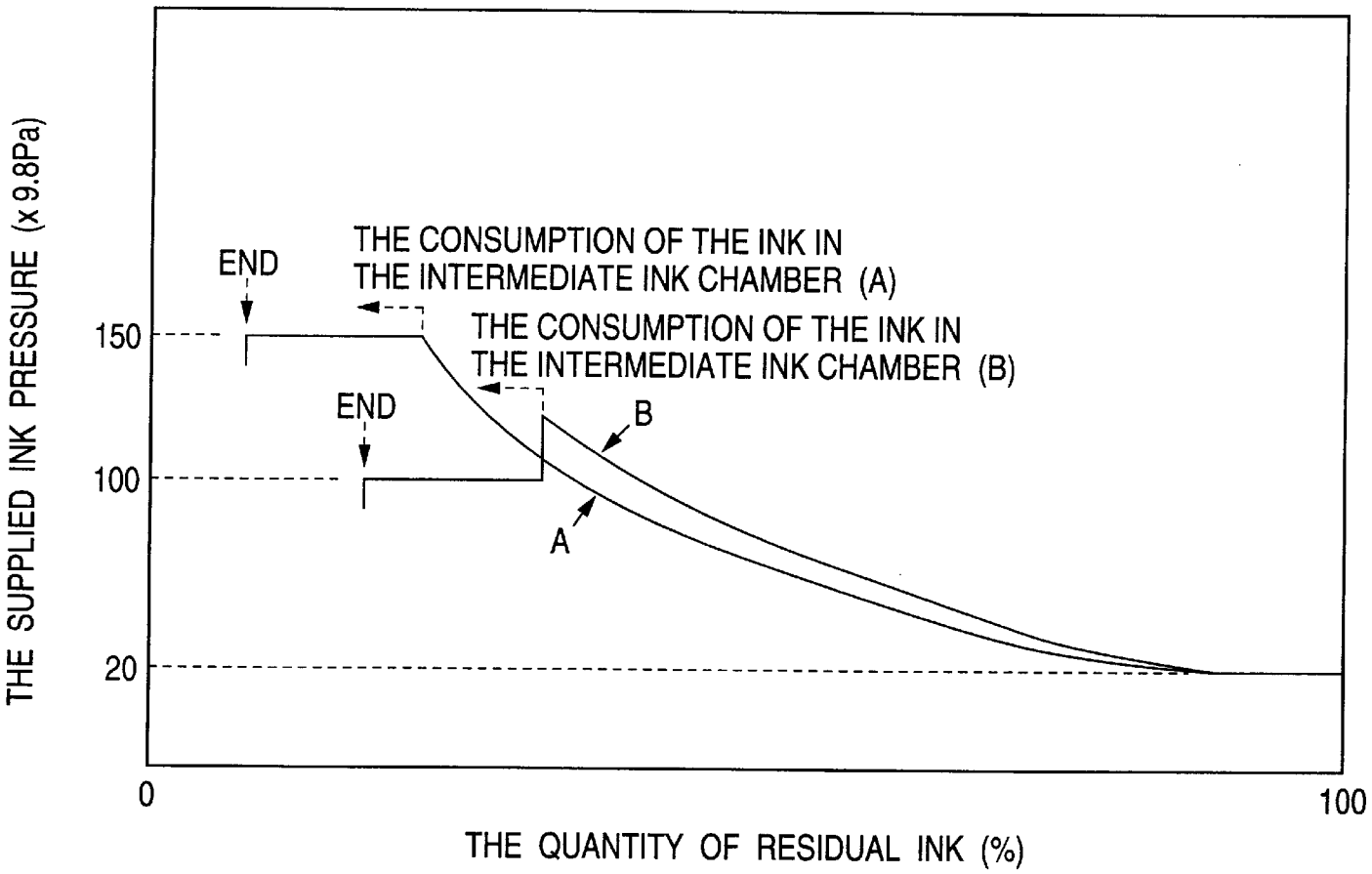
FIG. 13 is a graph showing the measured results of ink supply pressure of the ink supply device.

The ink supply device satisfying the relation above is capable of improving efficiency of use of ink. FIG. 13 is a graph showing the measured results of ink supply pressure of the ink supply device, wherein a curve A represents variations in the ink supply pressure in this embodiment of the invention and satisfies the relation above. A curve B represents variations in the conventional ink supply pressure and in this case, the bubble point pressure of the first meniscus forming member is lower than the combined pressure PZ obtained from the pressure PR by means of the capillary force generated by the capillary member and the ink in the main ink chamber, and the hydraulic head pressure PH generated by the residual solid ink. As shown by the graph, the time when the ink in the intermediate ink chamber is consumed refers to a state in which the printing operation results in consuming the ink while the air communicating with the atmospheric air through the communicating-with-air hole is penetrating into the intermediate ink chamber due to the bubble point pressure via the first meniscus forming member.

As shown by the curve A, the bubble point pressure of the meniscus forming member is set so that it is always larger than the combined pressure PZ obtained from the pressure PR by means of the capillary force generated by the capillary member and the ink in the main ink chamber, and the hydraulic head pressure PH generated by the residual solid ink. Consequently, the supplied ink pressure has become the largest negative pressure when the ink in the intermediate ink chamber is supplied to the head with the bubble point pressure. Since the bubble point pressure of the first meniscus forming member is relatively higher than the negative pressure in the capillary member, the quantity of residual ink remaining in the capillary member in the proximity of the first meniscus forming member is reducible and therefore a point of time the ink in the intermediate ink chamber is consumed has shifted leftward from the curve B.

As shown by the curve B, on the other hand, the bubble point pressure of the meniscus forming member is lower than the combined pressure PZ obtained from the pressure PR by means of the capillary force generated by the capillary member and the ink in the main ink chamber, and the hydraulic head pressure PH generated by the residual solid ink. Consequently, the ink supply pressure in the last portion during which the ink in the capillary member is consumed become highest and then the supply pressure is lowered after the penetration of the air from the meniscus forming member with the bubble point pressure. When the position of the ink supply device is changed in this state, the hydraulic pressure of the residual solid ink varies and the combined pressure PZ becomes larger, thus inducing a great deal of ink-to-air substituting phenomenon as described above. Although a description has been given of the hydraulic pressure of ink by reference to the residual solid ink, the ink has not yet consumed to the extent that the residual solid ink is produced in the state of FIG. 5. In this case, the ink in the main ink chamber 2 is kept in contact with the first meniscus forming member 7. Therefore, the hydraulic pressure PH in question is said to be what acts on the surface of the first meniscus forming member 7 on the side of the main ink chamber 2. This hydraulic pressure PH is maximized in the state of FIG. 4 with reference to FIGS. 4 to 10.

The second meniscus forming member 12 as referred to in FIG. 3 functions as what prevents ink from leaking out from the ink supply device that has been removed and left alone and conversely prevents air from penetrating into an ink tank 11. While ink is held in the capillary member of the main ink chamber in particular, the first meniscus forming member functions as a filter and liquidly communicates with a main ink chamber 12 and an intermediate ink chamber 14.

When the ink supply device is placed with the joint port upward, the negative pressure generated in the main ink chamber is made PR. Further, the hydraulic head of ink acting on the second meniscus forming member is similar to the hydraulic head PH acting on the surface of the first meniscus forming member on the main ink chamber side since the main ink chamber is kept liquidly communicating with the intermediate ink chamber. With the bubble point pressure of the second meniscus forming member 12 as PB2 in this case, if the following relation is satisfied, $$|PB2| \geqq |PR| + |PH|$$

no air is allowed to penetrate from the second meniscus forming member 12 into the ink supply device even when the ink supply device is placed upside down. The diameter of the meniscus opening of the second meniscus forming member 12 is defined by the surface tension of ink for use and a wetting angle together with the bubble point pressure as described above; to be concrete, the diameter ranges from 5 $\mu$m to 60 $\mu$m.

Figure 14:
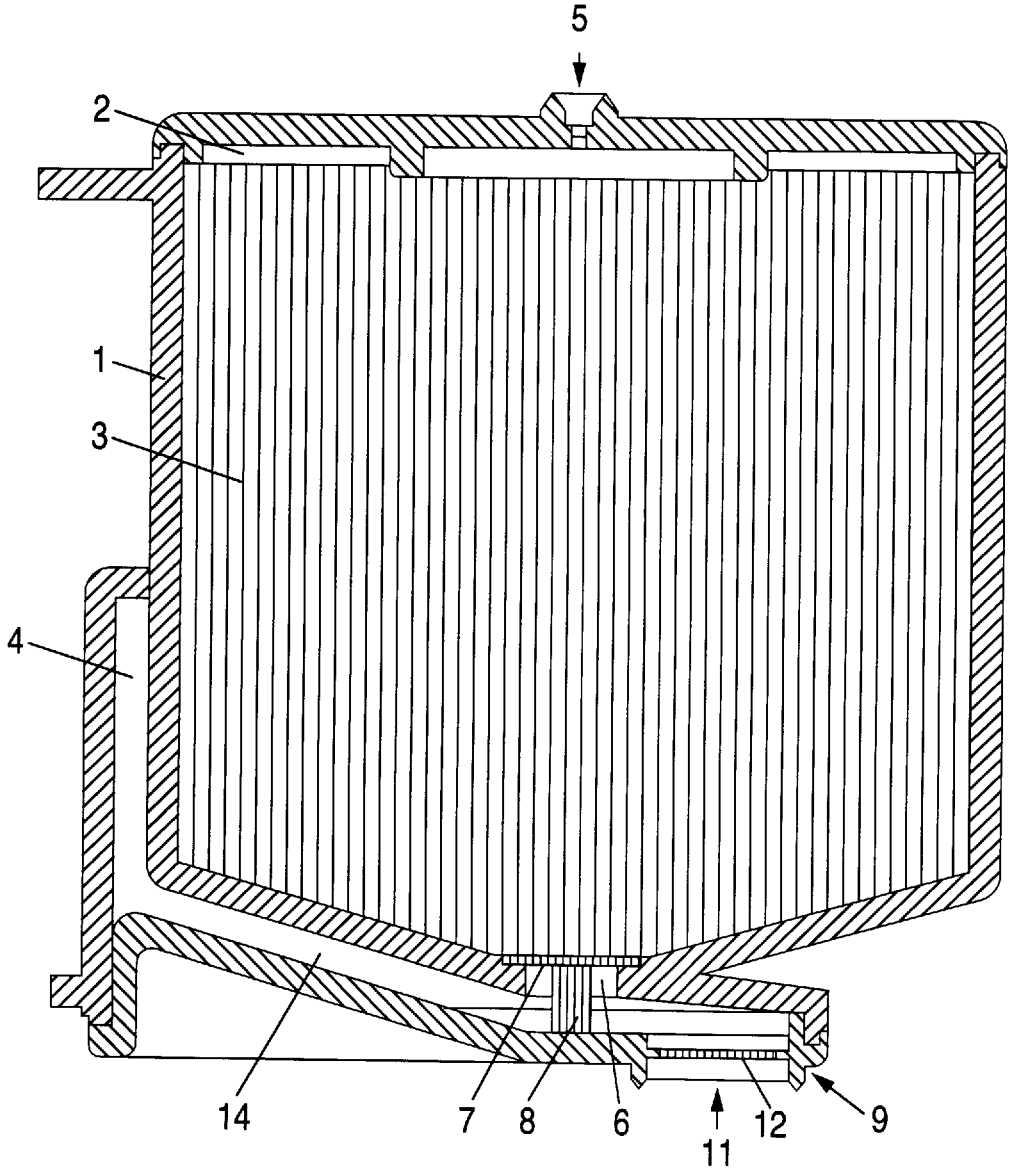
FIG. 14 is a sectional view of an ink supply device according to a second embodiment of the invention.
Figure 15:
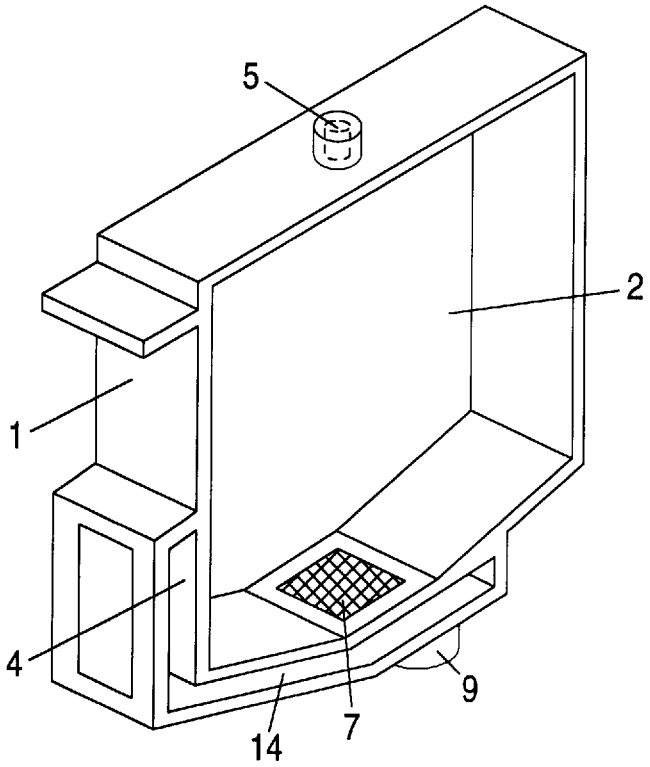
FIG. 15 is a perspective view of the ink supply device of FIG. 14.

FIGS. 14 and 15 are diagrams illustrating a second embodiment of the invention: FIG. 14 is a sectional view of an ink supply device and FIG. 15 a perspective view thereof, wherein like reference characters designate like or corresponding parts throughout and the description thereof will be omitted; incidentally, reference numeral 14 denotes a communicating path. As in FIG. 1A, the illustration of the side wall on this side and the capillary member 3 is omitted.

According to this embodiment of the invention, the cubic volume of the intermediate ink chamber 4 is reduced so as to communicate with the communicating hole 6 via the communicating path 14. The upper wall of the communicating path 14 is tilted so that it is directed upward to the intermediate ink chamber 4 as shown in FIG. 14, though it may be extended horizontally, whereby the bubbles produced in the communicating path 14 can be moved smoothly into the intermediate ink chamber 4. Although the tilted face is extended over only a section connecting the intermediate ink chamber 4 and the main ink chamber 2, the surface in a section connecting the main ink chamber 2 and the joint port 11 may also be tilted, so that the bubbles introduced from the joint port 11 are smoothly movable into the intermediate ink chamber 4. The base of the communicating path 14 is tilted in only a section where the intermediate ink chamber 4 communicates with the main ink chamber 2 according to this embodiment of the invention so as to reduce the quantity of residual ink, though the base thereof may be extended horizontally.

As in the first embodiment of the invention, the intermediate ink chamber 4 is initially filled with ink. The bubbles penetrated through the first meniscus forming member 7 from the main ink chamber 2 into the communicating path 14 are gathered. The size of the intermediate ink chamber 4 should be large enough to accumulate the bubbles unusually penetrated into the intermediate ink chamber 4 until the ink in the main ink chamber 2 is used up, so that a smaller intermediate ink chamber can be employed. In order to accumulate bubbles, moreover, the surface of the intermediate ink chamber 4 needs to be set higher than the communicating hole 6 of the main ink chamber 2.

It is obvious from the description above that the ink supply device even in this embodiment of the invention should be designed to satisfy the relation described in the first embodiment of the invention. Even when the ink supply device is left alone in various positions, the ink in the intermediate ink chamber 4 is thus prevented from moving toward the main ink chamber. Moreover, no air is allowed to penetrate from the second meniscus forming member into the intermediate ink chamber 4.

Figure 16:
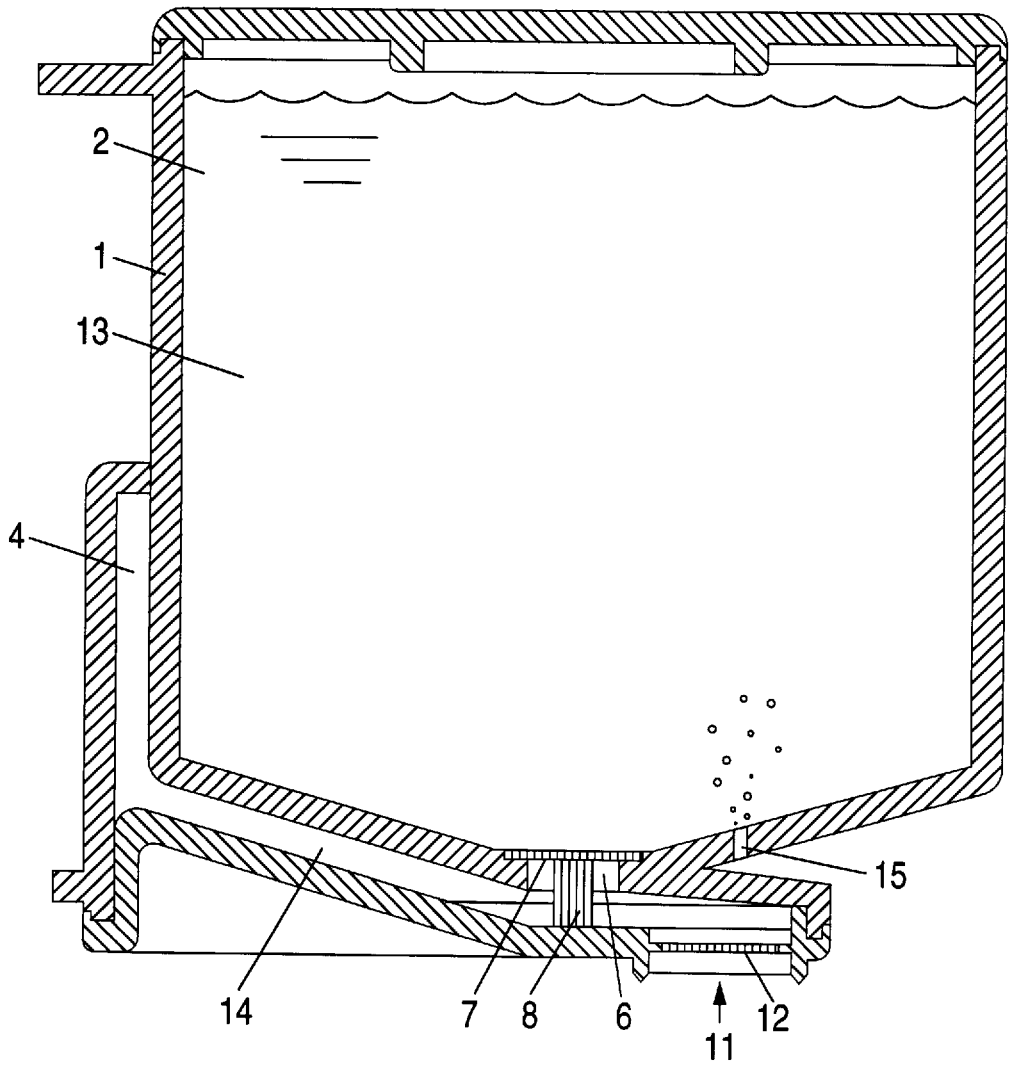
FIG. 16 is a sectional view of an ink supply device according to a third embodiment of the invention.

FIG. 16 is a sectional view of an ink supply device illustrating a third embodiment of the invention. In FIG. 16, like reference characters designate like or corresponding parts of FIGS. 1 to 3 and FIG. 17 and the description thereof will be omitted. Reference numeral 15 denotes a bubble generator.

According to this embodiment of the invention, it has been arranged that the negative pressure in the main ink chamber 2 is controlled by the bubble generator 15 using pores. In the housing 1 lie the main ink chamber 2 and the intermediate ink chamber 4 on the side of the main ink chamber 2 as in the second embodiment of the invention. The main ink chamber 2 is hermetically sealed and contains ink. A meniscus is formed in the bubble generator 15 by the ink 13 contained in the main ink chamber 2 and when the pressure in the main ink chamber 2 lowers, bubbles are produced in the main ink chamber 2 by external air. In consequence, the determination of the bubble point pressure in the pores is dependent on the negative pressure of ink under control.

In the third embodiment of the invention, only ink is contained in the main ink chamber 2 because no capillary member is employed, so that 100% of the capacity of the main ink chamber 2 is usable for containing ink. Therefore, the utilization efficiency of the ink supply device is made improvable. It is preferred to install the bubble generator 15 in a portion close to the base of the main ink chamber 2 because the ink in the main ink chamber 2 is used to the fullest.

The ink supply device even in the third embodiment of the invention is designed to satisfy the relation described in the first embodiment of the invention. Therefore, even when the ink supply device is left alone in various positions, the ink in the intermediate ink chamber 4 is prevented from moving toward the main ink chamber. Moreover, no air is allowed to penetrate from the second meniscus forming member into the intermediate ink chamber 4, thus preventing ink from flowing outside from the bubble generator 15. Incidentally, the intermediate ink chamber 4 may be placed under the main ink chamber without using the communicating path as in the first embodiment of the invention.

Figure 17:
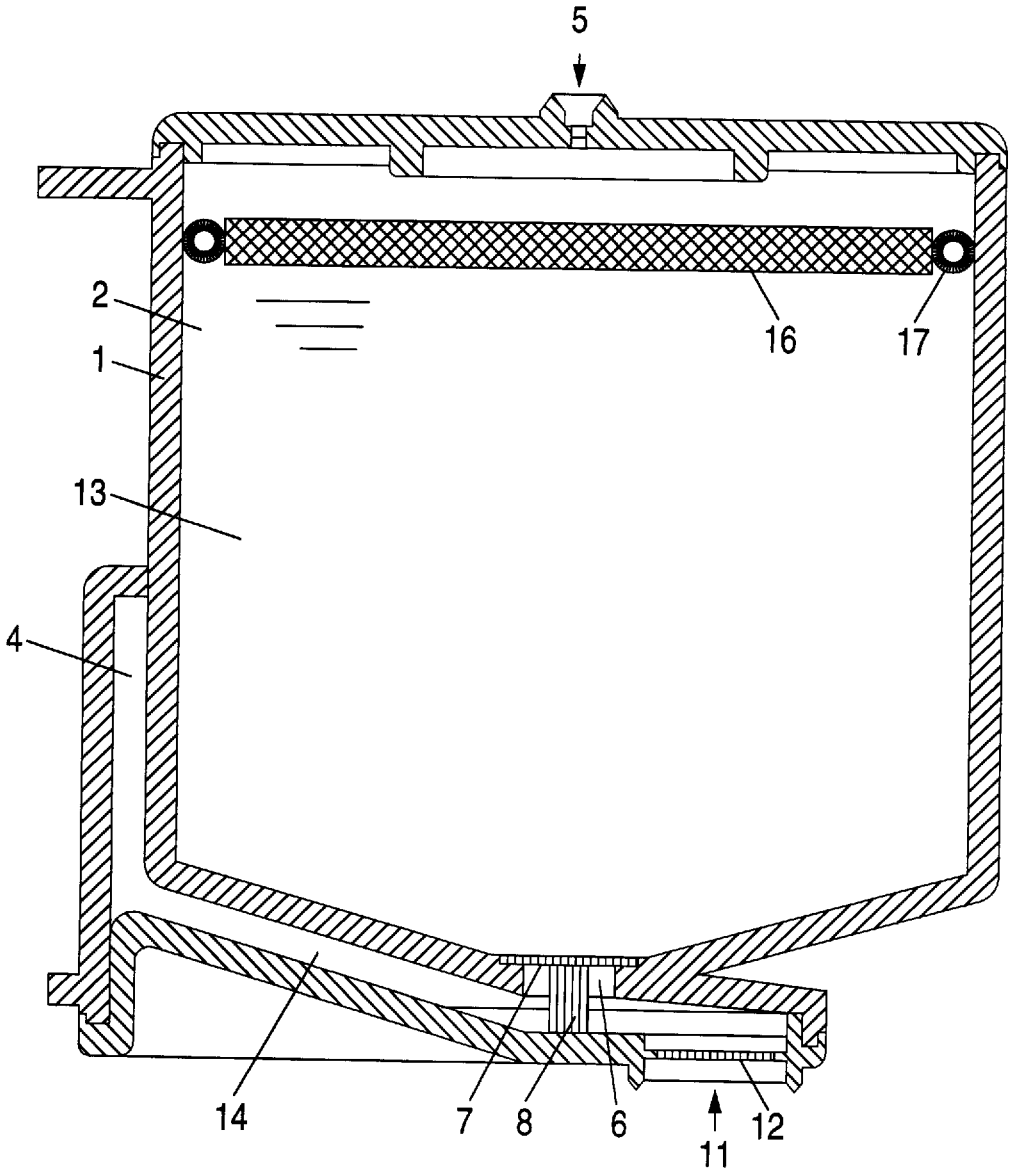
FIG. 17 is a sectional view of an ink supply device according to a fourth embodiment of the invention.

FIG. 17 is a sectional view of an ink supply device illustrating a fourth embodiment of the invention. In FIG. 17, like reference characters designate like or corresponding parts of FIGS. 1 to 3 and FIG. 17 and the description thereof will be omitted. Reference numeral 16 denotes a movable member; and 17, a seal member.

According to this embodiment of the invention, the movable member 16 in contact with the surface of the ink 13 is used. The surface of the movable member 16 is kept communicating with the communicating-with-air hole 5. The seal member 17 is employed in order to seal up ink and give a suitable frictional force to the surroundings of the movable member 16 and to the inner wall of the main ink chamber 2. A hollow tubular material may be used for providing suitable elasticity. Needless to say, there is no reason for limiting such a tubular material to a hollow one.

According to this embodiment of the invention, the negative pressure is made producible by the weight of the movable member 16 and the frictional force. Even in this embodiment of the invention, the ink supply device is designed to satisfy the relation described in the first embodiment of the invention. Therefore, even when the ink supply device is left alone in various positions, the ink in the intermediate ink chamber 4 is prevented from moving toward the main ink chamber. Moreover, no air is allowed to penetrate from the second meniscus forming member into the intermediate ink chamber 4. Even in this embodiment of the invention, the intermediate ink chamber 4 may be placed under the main ink chamber without using the communicating path 14 as in the first embodiment of the invention.

Figure 18:
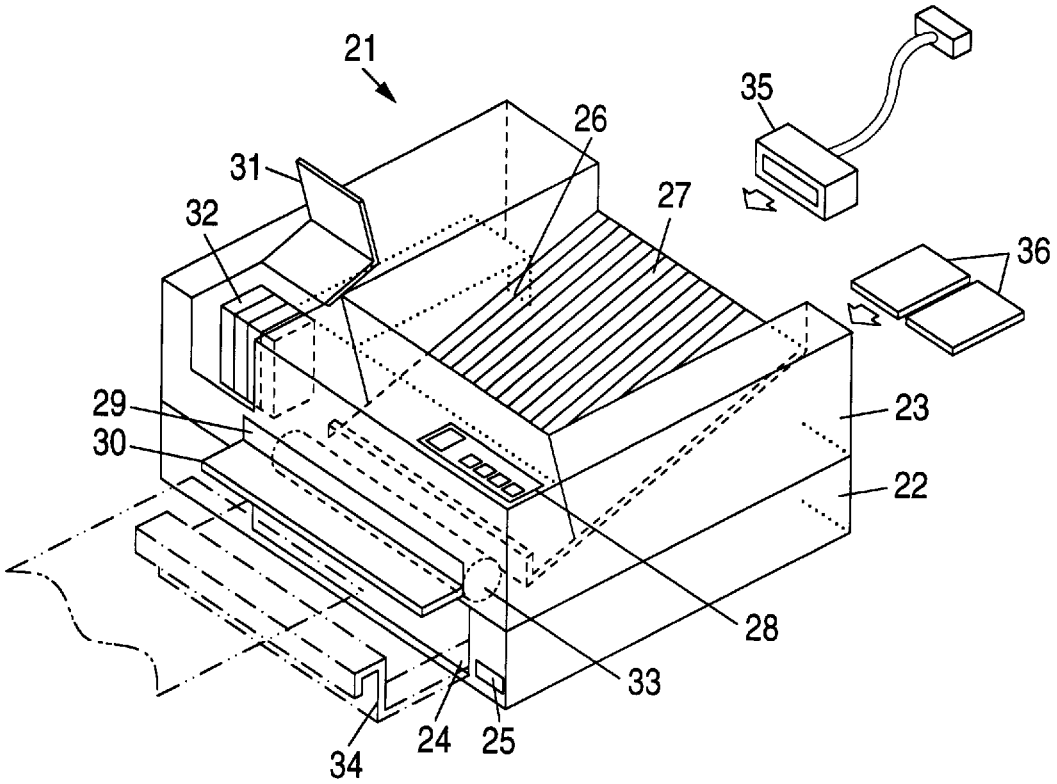
FIG. 18 is an external view of a recording apparatus embodying the present invention.

FIG. 18 is an external view of a recording. apparatus embodying the present invention. In FIG. 18, reference numeral 21 denotes a recording apparatus; 22, a lower casing; 23, a upper casing; 24, a tray insertion port; 25, a dip switch; 26, a main switch; 27, a paper receiver; 28, a panel console; 29, a manual insertion port; 30, a manual insertion tray; 31, an ink tank insertion lid; 32, an ink tank; 33, a paper feed roller; 34, a paper tray; 35, an interface cable; and 36, a memory card. In FIG. 18, there is shown the whole recording apparatus to which any one of the ink supply devices in the first to fourth embodiments of the invention is applied.

The cubic body of the recording apparatus 21 has the lower casing 22 and the upper casing 23 in which electric circuits and driving parts (not shown) are contained. The tray insertion port 24 is provided for the lower casing 22 and the paper tray 34 loaded with recording paper is inserted into the tray insertion port 24. Thus recording paper is loaded on the recording apparatus 21.

The lower casing 22 is fitted with the dip switch 25 and the main switch 26. The dip switch 25 is used to set part of the operation of the recording apparatus 21 and its functions less frequently subjected to setting alteration are allocated thereto. The dip switch 25 is covered up during the non-operation. The main switch 26 is used to turn on and off the power source of the recording apparatus 21. The lower casing 22 is further provided with an interface connector, an insertion port for the memory card 36 and the like (these being not shown). The interface cable 35 is connected to the interface connector so as to effect data exchange with external computers. The memory card 36 is used as an extended memory during the operation of the recording apparatus 21 and is stored with fonts in certain cases, which fonts are used during the recording operation.

The paper receiver 27 is formed in the upper casing 23 and paper bearing records is discharged therefrom. The panel console 28 is equipped with input means frequently used by the user for setting recording modes, giving instructions as to paper feeding, paper discharging and the like, and message display means for displaying messages from the recording apparatus. Moreover, the manual insertion port 29 and the manual insertion tray 30 are provided so that the user can feed paper manually therethrough.

Further, the ink tank insertion lid 31 is provided for the upper casing 23. By opening this lid, the ink tank 32 inside can be detached. The ink tank 32 for use is similar to those described in the preceding embodiments of the invention. In this case, four kinds of ink tanks 32 are installed and fitted to a recording head (not shown). The condition of installing these ink tanks is as shown in FIGS. 9 to 12. The recording head is fitted to a carriage (not shown).

The paper contained in the paper tray 34 is conveyed by an internal conveyer system (not shown) sheet by sheet along the circumference of the paper feed roller 33. The recording head (not shown) fitted with ink tanks 32 is moved in a direction perpendicular to the direction in which the paper is conveyed and recording is made on a belt area basis. The paper feed roller 33 then conveys the paper in the length direction of paper up to a recording position in the following belt area. This operation is repeated, so that recording is made on paper, which is then discharged onto the paper receiver 27 in the upper casing 23.

Although a description has been given of a case where the ink tanks 1 are installed in the print head 3 of the recording apparatus according to this embodiment of the invention, the print head 3 may be made detachable from the carriage of the recording apparatus, and the ink tanks 1 may be installed in the carriage, for example.

As is obvious from the foregoing description, according to the present invention, the aforesaid relation is satisfied, whereby the ink-to-air substituting phenomenon in the intermediate ink chamber is prevented in any position of the ink supply device. Efficiency of use of ink in the ink supply device can thus be improved. Even when the ink supply device is detached from the recording apparatus, air is prevented from penetrating into the ink supply device through the joint port and so is ink from flowing out.

What is claimed is:

1. An ink supply device for supplying ink to a print head, comprising:

a first meniscus forming member with pores and having a face, said first meniscus forming member formed in a communicating hole for use in supplying ink, a first ink chamber comprising a porous member and a bubble generator, said first ink chamber being capable of containing ink under a negative pressure, a joint portion communicating with said communicating hole and simultaneously with said print head, and a hermetically sealed second ink chamber, wherein the pores of the first meniscus forming member are sized such that the first meniscus forming member creates a bubble point pressure that satisfies the following relation:

$$|PB| \geqq |PR| + |PH|$$

where

PR=negative pressure generated in said first ink chamber;

PB=bubble point pressure of said first meniscus forming member; and

PH=hydraulic head pressure of ink acting on the face on a first ink chamber side of said first meniscus forming member.

2. The ink supply device of claim 1, wherein said first ink chamber includes:

a communicating-with-air hole communicating with external atmospheric air and said porous member communicating with said communicating-with-air hole and the negative pressure is generated by capillary force of said porous member.

3. The ink supply device of claim 1, wherein said bubble generator is disposed on a wall common to said first and said second ink chambers, wherein the negative pressure is enhanced by said bubble generator.

4. The ink supply device of claim 1, wherein said first ink chamber includes:

a movable member for containing ink so that the negative pressure is maintained by said movable member.

5. The ink supply device of claim 2, wherein said porous member is formed of polyester felt whose density ranges from 0.04 g/cm$^3$ to 0.2 g/cm$^3$.

6. The ink supply device of claim 1, wherein said first meniscus forming member is a twill fabric filter of SUS whose filtering particle size ranges from about 5 $\mu$m to about 80 $\mu$m.

7. The ink supply device of claim 1, wherein said joint portion of said second ink chamber includes: a second meniscus forming member, and the following relation is satisfied:

$$|PB2| \geqq |PR| + |PH|$$

where

PB2=bubble point pressure of said second meniscus forming member;

PR=negative pressure generated in said first ink chamber; and

PH=hydraulic head pressure of ink acting on the face on said first ink chamber side of said first meniscus forming member.

* * * * *